US006007217A

United States Patent [19]

Ferrier

[11] Patent Number: 6,007,217

[45] Date of Patent: Dec. 28, 1999

[54] LUMINAIRE ASSEMBLY MOUNTING SYSTEM

[75] Inventor: David James Ferrier, Vancouver, Canada

[73] Assignee: Ledalite Architectural Products, Inc., St. Langley, Canada

[21] Appl. No.: 09/071,628

[22] Filed: May 1, 1998

[51] Int. Cl.[6] ..... F21S 3/00

[52] U.S. Cl. ..... 362/220; 362/368

[58] Field of Search ..... 362/217, 220, 362/223, 225, 368, 269, 285, 277

[56] References Cited

U.S. PATENT DOCUMENTS

| | | | |
|---|---|---|---|
| 2,428,827 | 10/1947 | Beck | 240/9 |
| 3,070,689 | 12/1962 | McIntosh | 240/51.11 |
| 4,158,221 | 6/1979 | Agabekov | 362/219 |
| 4,338,653 | 7/1982 | Marrero | 362/223 |
| 4,717,993 | 1/1988 | Bernhart et al. | 362/219 |
| 4,980,808 | 12/1990 | Lilos | 362/219 |
| 5,050,047 | 9/1991 | Viner et al. | 362/32 |
| 5,221,138 | 6/1993 | Bostjancic et al. | 362/221 |
| 5,658,066 | 8/1997 | Hirsch | 362/219 |

*Primary Examiner*—Cassandra Spyrou
*Assistant Examiner*—Leo Boutsikaris
*Attorney, Agent, or Firm*—Stoel Rives LLP

[57] ABSTRACT

A mounting system facilitates attachment of a luminaire assembly to a mounting surface at various positions to vary the direction of the maximum output of the luminaire assembly. A preferred embodiment of the luminaire assembly includes a mounting system that comprises a substantially U-shaped body having a wall formed with multiple discrete angularly inclined mounting sections. The mounting sections have associated mounting tabs for securing the luminaire assembly to a surface. The mounting system also includes a tab-receiving embossment on each mounting section to receive an associated tab of an adjacent mounting system for mounting multiple luminaire assemblies in a flush end-to-end relation.

5 Claims, 5 Drawing Sheets

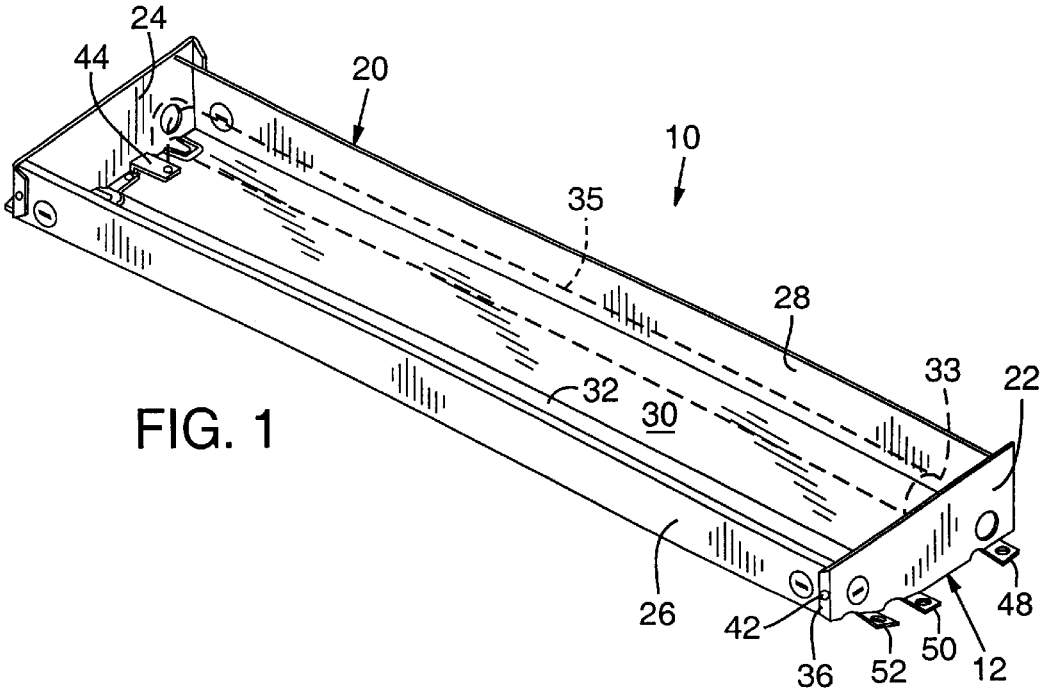
FIG. 1
FIG. 2
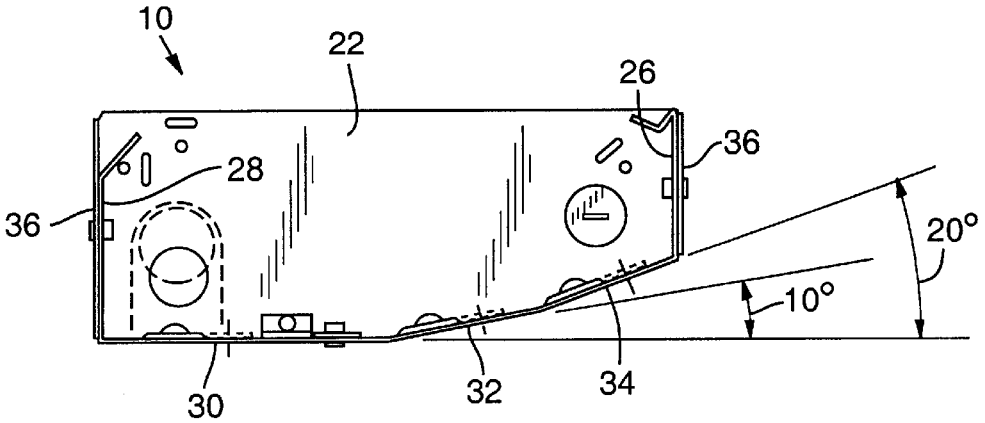

LUMINAIRE ASSEMBLY MOUNTING SYSTEM

TECHNICAL FIELD

The present invention is generally related to lighting supports and, more particularly, to a mounting system for a luminaire assembly.

BACKGROUND OF THE INVENTION

There are currently available various mounting systems for cove-mounted fluorescent luminaire assemblies. Such mounting systems are, however, limited to directing in only one direction the peak light output emanating from a luminaire assembly. For example, many fluorescent mounting systems hang down from a room ceiling in a drop-mounted fashion to downwardly direct most of the light emanating from a luminaire assembly. Such an arrangement creates harsh lighting conditions for some applications. Other mounting systems, such as wall-mounted fixtures, have only one mounting position. These systems are also limited in that they provide maximum light output in only one direction for either direct or indirect lighting. Depending on the application, such lighting from currently available wall-mounted systems may be either inadequate or excessive. To obtain various lighting conditions for different applications would require a different mounting system for each desired lighting condition. Such a requirement would be impractical from a design standpoint, in addition to being costly.

The lack of flexibility in prior luminaire assembly mounting systems extends to luminaire assemblies mounted in an end-to-end fashion. Current lighting systems do provide some type of joining mechanism for connecting adjacent luminaire assemblies; however, their mounting systems offer limited flexibility in adjustment of the direction of maximum light output.

SUMMARY OF THE INVENTION

An object of the invention is, therefore, to provide a mounting system for selectively directing the maximum output of a luminaire assembly at different angles for different applications.

Another object of the invention is to provide such a mounting system that can accommodate flush mounting multiple luminaires in an end-to-end manner.

The present invention is a mounting system for a luminaire assembly that can be selectively attached at various positions to a mounting surface to vary the direction of the maximum output of the luminaire assembly. A preferred embodiment of the luminaire assembly includes a mounting system that comprises a substantially U-shaped body having a wall formed with multiple angularly inclined mounting sections. The mounting system includes at least one end plate that has a mounting tab associated with each mounting section. The luminaire assembly may be secured to a surface by placing a selected mounting section with its associated tab against the surface and securing the tab to the surface with a connector, such as a screw. The mounting system also includes a tab-receiving embossment on each mounting section to receive an associated tab of a corresponding mounting section of an adjacent mounting system for mounting multiple luminaire assemblies in a flush end-to-end relation.

The foregoing and other objects, features, and advantages of the invention will be more readily understood upon consideration of the following detailed description a preferred embodiment of the invention, taken in conjunction with the accompanying drawings.

BRIEF DESCRIPTION OF THE DRAWINGS

FIG. 1 is an isometric view of the mounting system of the present invention with a linear lamp bulb shown in phantom.

FIG. 2 is an end view of the mounting system as seen with one of the end plates removed.

DETAILED DESCRIPTION OF A PREFERRED EMBODIMENT

Figure 3:
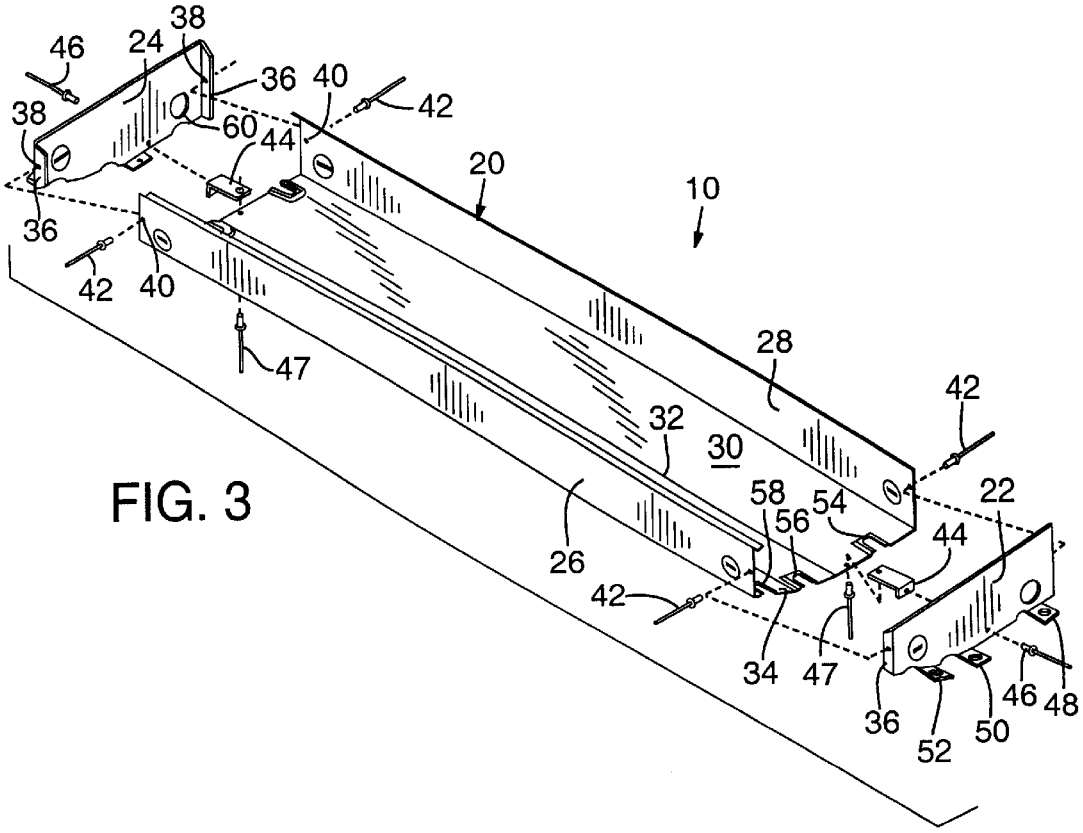
FIG. 3 is an exploded isometric view of the mounting system.

FIGS. 1 and 2 show a luminaire assembly 10 that includes a mounting system 12 of the present invention. Luminaire assembly 10 is preferably of an asymmetric type such as that described in U.S. Pat. No. 5,727,870 in which the distribution of light emitted by a horizontally disposed linear lamp is asymmetric about a vertical axis. In a preferred embodiment, mounting system 12 is an integral part of a substantially U-shaped body 20 covered with end plates 22 and 24 and formed with side walls 26 and 28 and a rear wall divided into distinct angularly inclined mounting sections 30, 32, and 34 positioned between side walls 26 and 28. Body 20 near at least one of end plates 22 and 24 has a socket 33 for receiving one or more linear lamp bulbs 35, such as fluorescent lamp tubes (one of which shown in phantom), in a well-known manner. Mounting unit 10 is adapted to be mounted to a surface, such as a wall, at a selected one of multiple positions to direct the maximum output from the luminaire in a desired direction. This is achieved by selecting one of mounting sections 30, 32, and 34, placing the selected mounting section flat against the wall or other surface, and securing mounting system 12 to it.

As seen most clearly in FIG. 2, mounting sections 30, 32, and 34 are substantially flat sections angled with respect to each other. For example, section 30 is shown to be substantially perpendicular to side wall 26. Section 32 is shown inclined at an angle of about 10° relative to section 30, and section 34 is inclined at an angle of about 20° relative to section 30.

As seen most clearly in FIG. 3, end plates 22 and 24 are attached to opposite ends of body 20. End plates 22 and 24 are handed but otherwise of the same construction; therefore, the description of their attachment to body 20 will be made primarily with reference to end plate 24. End plate 24 has flanges 36 that include holes 38 positioned for alignment with corresponding holes 40 in body 20. End plate 24 is secured to body 20 by pop rivets 42. To provide a more stable attachment, an optional L-shaped bracket 44 is secured at one end to end plate 24 by a pop rivet 46 and at the other end to section 34 of body 20 by a pop rivet 47. As seen most clearly with reference to end plate 22, each end plate is formed with a bottom edge having a shape that corresponds to the shape defined by sections 30, 32, and 34 of body 20. Multiple mounting tabs 48, 50, and 52 extend outwardly from the bottom edge of end plate 22 so that each mounting tab 48, 50, and 52 corresponds to one of sections 30, 32, and 34 of body 20 for mounting system 12 to a surface.

Once the proper lighting conditions are determined, the one of the mounting sections 30, 32, and 34 is selected and placed against the surface to which luminaire assembly 10 is to be attached. The one of mounting tabs 48, 50, and 52 corresponding to the selected one of mounting sections 30, 32, and 34 lies flat against the surface, and luminaire assembly 10 is then secured to the surface by a connector such as by passing a screw through a hole in the mounting tab.

Figure 4:
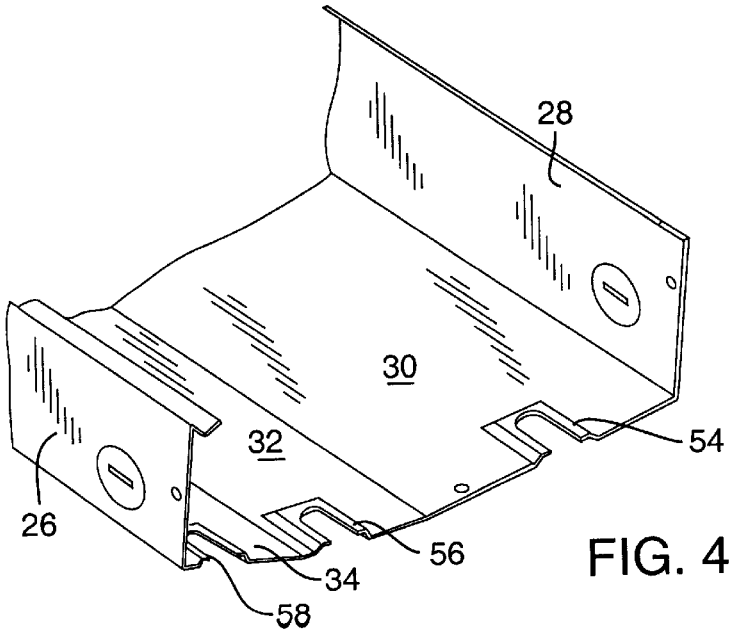
FIG. 4 is an enlarged fragmentary isometric view of one end of the mounting system with its end plate removed.
Figure 5A:
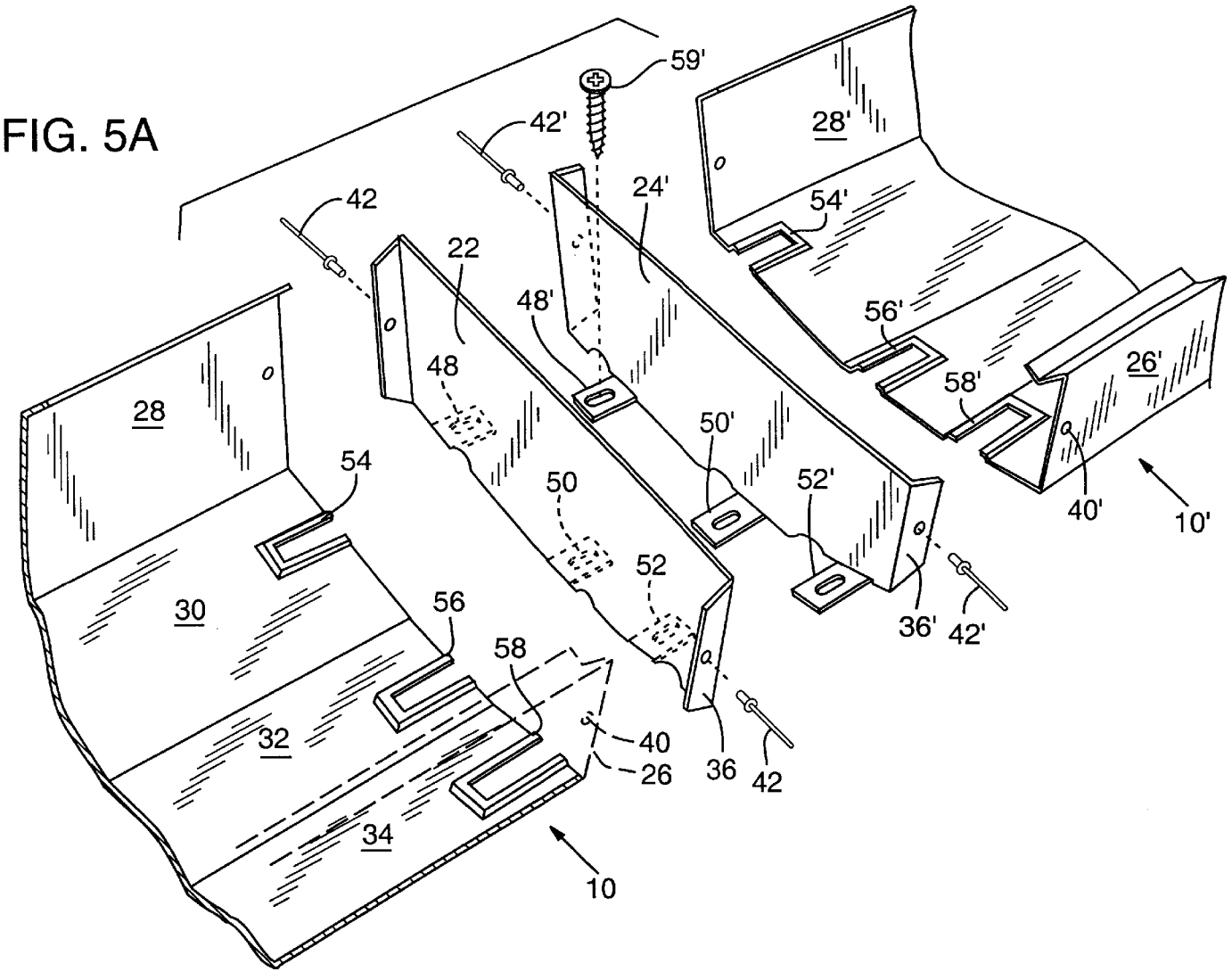
FIGS. 5A and 5B are enlarged, fragmentary isometric views of two alternative techniques for end-to-end mounting of two luminaire assemblies.

Mounting system 12 is adapted so that a luminaire assembly 10 can be mounted in a flush end-to-end manner with an adjacent luminaire assembly 10' of the same design. As shown most clearly in FIG. 4, body 20 of mounting system 12 includes tab-receiving embossments 54, 56, and 58 associated with the respective sections 30, 32, and 34. As shown in FIGS. 5A and SB, these embossments are adapted to receive mounting tabs 48', 50', and 52', which are similar to mounting tabs 48, 50, and 52, from an adjacent mounting system 12' for end-to-end mounting of multiple luminaire assemblies.

FIG. 5A shows an alignment technique in which luminaire assembly 10 has an attached end plate 22 and luminaire assembly 10' has an attached end plate 24'.

Each of embossments 54, 56, and 58 of luminaire assembly 10 has a U-shaped cut-out portion of a size that fits over a screw 59' passing through one of the associated mounting tabs 48', 50', and 52' (tab 48' shown as an example) and thereby securing luminaire assembly 10' to the surface. Mounting tabs 48, 50, and 52 of luminaire assembly 10 fit into the respective tab-receiving embossments 54', 56', and 58' of luminaire assembly 10' to fix luminaire assembly 10 against the surface.

Figure 5B:
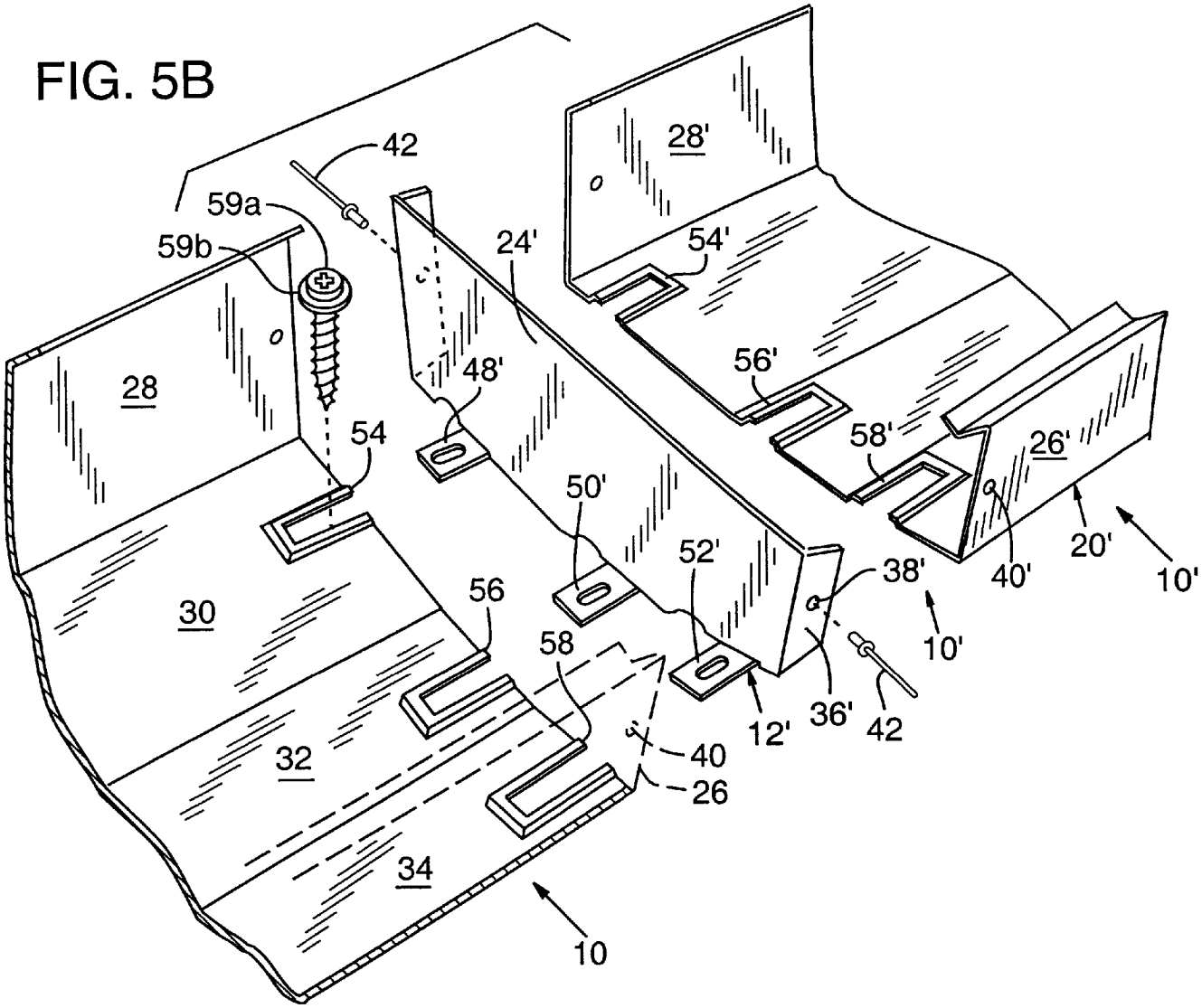

FIG. 5B shows an alternative alignment technique in which end plate 22 is not used on the end of luminaire assembly 10 to which adjacent luminaire assembly 10' is attached. Each of embossments 54, 56, and 58 allows access to a connector such as a screw 59*a* and washer 59*b* for securing the associated mounting tab (tab 48' shown as an example) to the surface.

As shown in FIG. 3, end plates 22 and 24 also include knock-out holes 60 that allow electrical wire access to adjoining luminaire assemblies without requiring a dismantling of mounting system 12.

Figure 6:
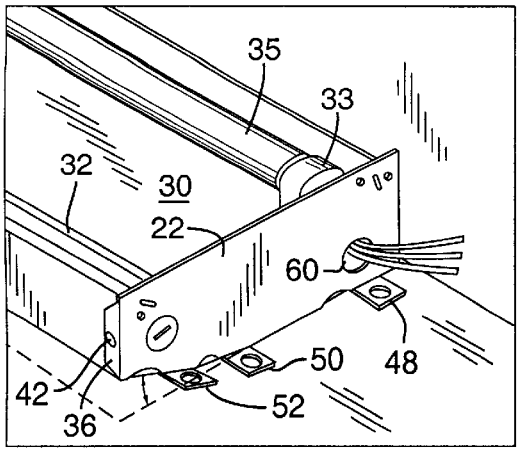
FIG. 6 is a fragmentary isometric view of the mounting system shown mounted in one position to a horizontal surface.
Figure 7:
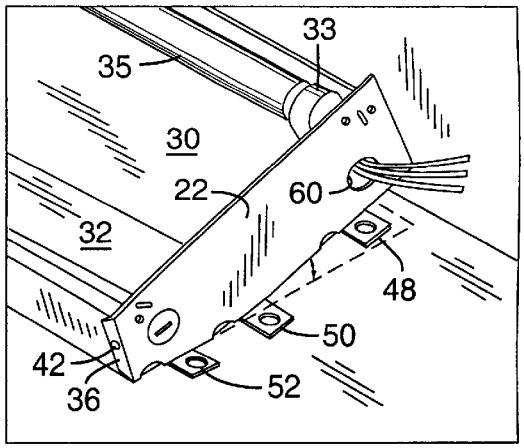
FIG. 7 is a view similar to that of FIG. 6 in which the mounting system is mounted in an alternative position to a horizontal surface.
Figure 8:
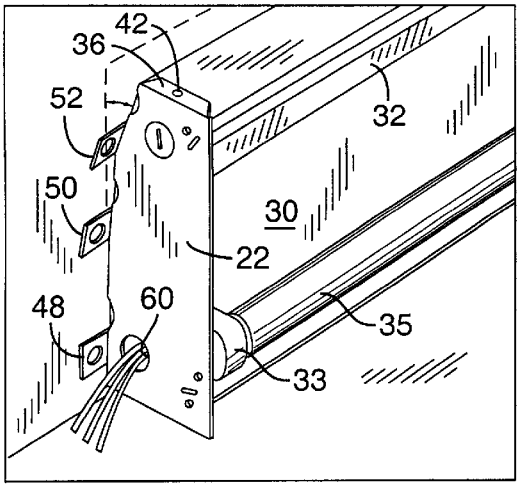
FIG. 8 is a fragmentary isometric view of the mounting system shown mounted in a first position to a vertical surface.
Figure 9:
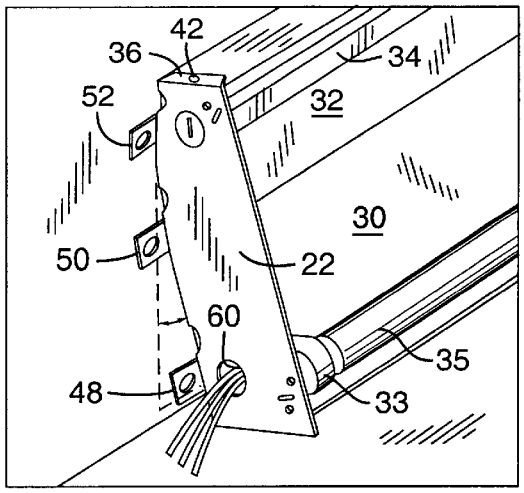
FIG. 9 is a view similar to FIG. 8 showing the mounting system mounted in a second position to a vertical surface.
Figure 10:
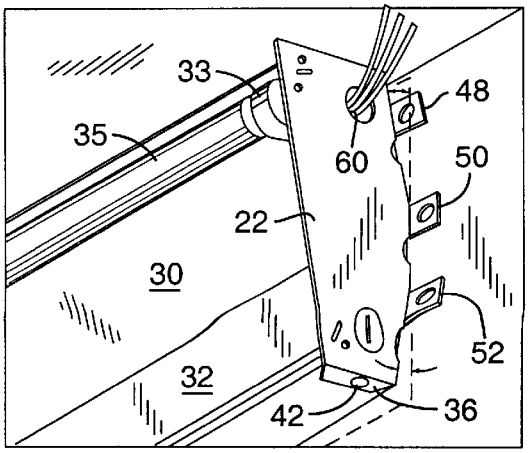
FIG. 10 is a view similar to FIG. 8 showing the mounting system mounted in a third position to a vertical surface.

FIGS. 6–10 show various mounting positions of a mounting system 12 for directing the maximum output of a fluorescent luminaire in a desired direction for different applications. (The projections of the luminaires onto the mounting surfaces are shown in broken lines.) For example, FIG. 6 shows mounting system 12 secured to a horizontal surface with mounting section 30 substantially flat against the surface. Mounting system 12 is secured to the surface by a fastener extending through mounting tab 48. In this position, the peak output of the luminaire is directed at an angle of about 125° relative to the surface. FIG. 7 shows mounting system 12 connected to a horizontal surface with the use of mounting tab 52 associated with mounting section 34. This position directs the peak output from the luminaire at an angle of about 105° relative to the surface. FIG. 8 shows mounting system 12 connected to a vertical surface with the use of mounting tab 48 associated with mounting section 30 to project the peak output of the luminaire at an angle of about 145° relative to the vertical surface. FIG. 9 shows mounting system 12 mounted to a vertical surface and secured thereto with the use of mounting tab 52 associated with mounting section 34 to project the peak output at an angle of about 165° relative to the surface. FIG. 10 shows mounting system 12 secured to a vertical surface with the use of mounting tab 50 associated with mounting section 32 to direct peak output from the luminaire at an angle of about 145° relative to the surface. It should be understood that these examples are but a few of the positions the mounting unit is capable of being mounted.

It will be obvious to those having skill in the art that many changes may be made to the details of the above-described embodiment of this invention without departing from the underlying principles thereof. The scope of the present invention should, therefore, be determined only by the following claims.

The invention claimed is:

1. In a luminaire assembly, a mounting system for selectively orienting at a desired angle the maximum light output emanating from the luminaire assembly, comprising:

a body having multiple distinct mounting sections for positioning one of said sections of the mounting system flat against a surface to direct maximum light output from the luminaire assembly at a selected one of multiple distinct angles; and at least one end plate secured to the body at one end and having a mounting tab associated with each mounting section of the body, wherein each said mounting tab secures the associated one of said sections to said surface, thereby securing the mounting system of the luminaire assembly to direct its maximum light output in a desired direction set by the selected angle.

2. The mounting system of claim 1, in which the body is substantially U-shaped and the multiple distinct mounting sections are substantially flat surfaces, each mounting section being angularly inclined relative to another of the mounting sections.

3. The mounting system of claim 2, in which the multiple mounting sections comprise a first mounting section and a second mounting section, the first mounting section constituting a reference surface and the second mounting section being inclined at an acute angle relative to the first mounting section.

4. The mounting system of claim 3, further comprising a third mounting section that is inclined at an angle that is greater than the acute angle relative to the first mounting section.

5. The mounting system of claim 1, in which the body includes tab-receiving recesses that are adapted to receive corresponding mounting tabs of an adjacent mounting system of a luminaire assembly posiitioned in end-to-end fashion.

* * * * *